United States Patent [19]

Banich, Sr. et al.

[11] 4,373,641

[45] Feb. 15, 1983

[54] PLASTIC CLOSURE AND RELATED CONTAINER FINISH

[75] Inventors: John N. Banich, Sr., Chicago; Donald H. Zipper, Western Springs, both of Ill.

[73] Assignee: The Continental Group, Inc., Stamford, Conn.

[21] Appl. No.: 241,972

[22] Filed: Mar. 9, 1981

[51] Int. Cl.[3] ..... B65D 41/06

[52] U.S. Cl. ..... 215/331; 215/332

[58] Field of Search ..... 215/331, 332, 31; 220/296

[56] References Cited

U.S. PATENT DOCUMENTS 942,141 12/1909 Hoffman ..... 215/332

4,166,552 9/1979 Faulstich ..... 215/31 X

*Primary Examiner*—Donald F. Norton

*Attorney, Agent, or Firm*—Charles E. Brown

[57] ABSTRACT

This relates to an improvement in the neck finish of a container and skirt of a cooperating closure to eliminate or substantially reduce squaring which exists in present closure-neck finish arrangements. The neck finish is constructed so as to control the torque required to apply the closure after it has been seated, thereby holding to a maximum the pressures which normally effect squaring. At the same time, the neck finish is provided with a supporting surface engageable by the closure skirt so as to permit supporting of the closure skirt against the undesired squaring.

4 Claims, 5 Drawing Figures

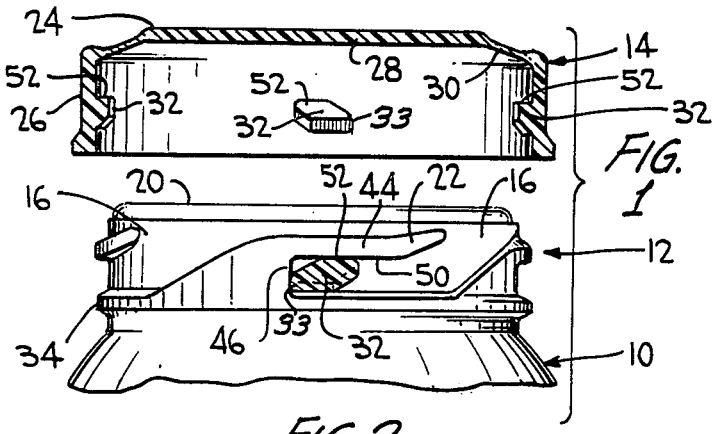
FIG. 1
FIG. 2
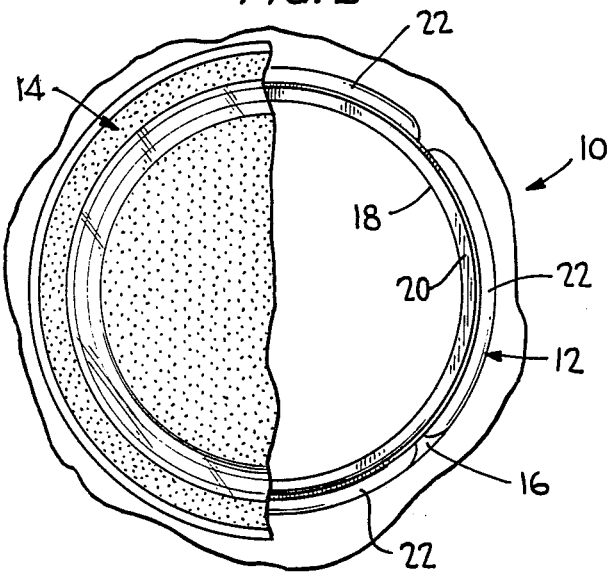
FIG. 3
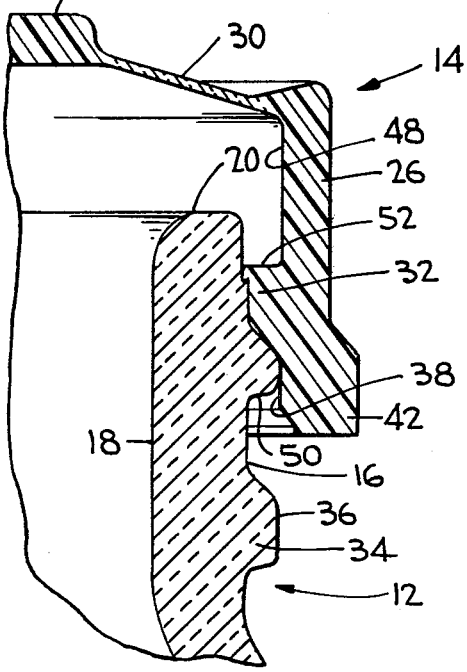
FIG. 4
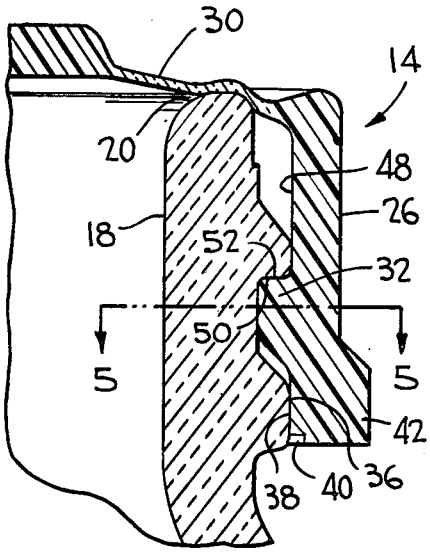
FIG. 5
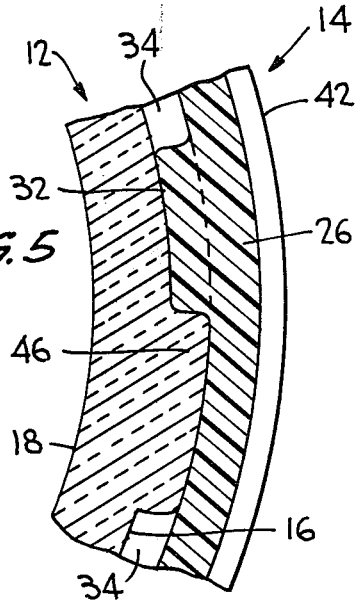

PLASTIC CLOSURE AND RELATED CONTAINER FINISH

This invention relates in general to new and useful improvements in containers and closure caps therefor, and more particularly to a container neck finish of the type having thread segments and a plastic closure cap having lugs thereon for engaging the thread segments.

Multi-lugged closures are notorious for squaring (i.e. bulging at the points of closure lug and container thread contact), creating a chord between the lugs when applied to the associated container.

In accordance with this invention, squaring is eliminated or at least greatly reduced by providing the neck finish with a radially outwardly projecting supporting surface below the thread segments which is tightly engaged by a lower portion of the closure shirt. Further, this lower portion may be reinforced by a thickening of the skirt wall.

Another feature of the invention is to provide the neck finish thread segments with lower terminal portions which are generally horizontal or which lie in a plane disposed normal to the axis of the neck finish.

Another feature of the invention to prevent or substantially reduce squaring is to restrict the amount of tension that may be placed on the skirt by providing stops engageable by the closure lugs so as to limit the rotational movement of the closure relative to the neck finish.

In a preferred embodiment of the invention, the neck finish will have a supporting surface in the form of a continuous annular bead, the thread segments will have lower terminal portions which are generally parallel to the supporting surface defining bead, and the stops will extend between the lower terminal ends of the thread segments and the supporting surface defining bead.

In addition, the contact angle on the underside of each thread segment and the top surface of a cooperating lug is minimized (retained between 0° and 10°) to keep a lug from riding over a container thread segment.

With the above and other objects in view that will hereinafter appear, the nature of the invention will be more clearly understood by reference to the following detailed description, the appended claims, and the several views illustrated in the accompanying drawings.

IN THE DRAWINGS

FIG. 1 is an exploded fragmentary elevational view of an upper part of a container including its neck finish and an associated closure with the closure being in diametrical vertical section.

FIG. 2 is a plan view of the container and closure in assembled relation with parts of the closure being broken away.

FIG. 3 is an enlarged fragmentary vertical sectional view showing the closure initially applied to the neck finish with the lugs resting on the thread segments.

FIG. 4 is an enlarged fragmentary vertical sectional view similar to FIG. 3, and shows the closure fully applied to the container.

FIG. 5 is a fragmentary horizontal sectional view taken generally along the line 5—5 of FIG. 4, and shows the lug engaging the stop of the neck finish.

Referring now to the drawings in detail, it will be seen that the invention relates to a container 10 having a neck finish 12 to which there is applied a closure 14. The illustrated container is formed of glass, but may be formed of other materials including plastics and metal. The material from which the container 10 is formed is not a part of this invention.

The neck finish 12 includes a neck 16 defining an internal pouring throat 18. The neck finish 12 includes a terminal end portion 20 against which the closure 14 seals.

The neck finish 12 customarily includes thread segments 22 which project radially outwardly from the outer surface of the neck 16. The neck finish 12 so far described is conventional.

The closure 14 is preferably formed of a plastic material and includes an end wall 24 and a depending skirt 26. In the illustrated embodiment, the end wall 24 includes a relatively thick central panel portion 28 which is joined to the skirt 26 by a readily deformable annular sealing portion 30 which is materially thinner than the end panel 28 and the skirt 26.

The skirt 26 has integrally formed on the inner surface thereof radially inwardly projecting, circumferentially spaced lugs 32. The lugs 32 are engageable beneath the thread segments 22 to secure the closure 14 on the neck finish 12. As is best shown in FIG. 4, when the closure 14 is applied, the annular portion 30 of the end wall 24 engages the terminal sealing surface 20 and is deflected axially upwardly, thereby to assure a tight seal. It is to be understood, however, that features of the invention to be described in detail hereinafter may also be advantageously utilized in conjunction with a closure wherein the end wall 24 is of a constant thickness.

The neck finish 12 and the closure 14 are specifically constructed so as to eliminate or substantially reduce squaring of the closure side wall or skirt when applied to the neck finish 12. A number of features are involved in the modification of the neck finish and the closure to effect the elimination or substantial reduction of the aforementioned squaring.

First of all, axially below the lower terminal ends of the thread segments 22, the neck finish 12 includes a radially outwardly projecting bead 34 which defines an outer support surface 36. The bead 34 is preferably continuous. The purpose of the bead 34 is to support the lower portion of the skirt 26. As is best shown in FIG. 4, the skirt 26 has a lower radially inner surface 38 of a diameter which substantially corresponds to the diameter of the support surface 36 so that when the closure 14 is applied to the neck finish 12, the skirt surface 38 will snugly engage the support surface 36 and maintain the circular configuration of the lower part of the skirt 26. This, in turn, will support the skirt 26 against the customary squaring.

If desired, the inner surface of the skirt 26 at its lower end may be relieved as at 40 to facilitate the aligning of the skirt 26 radially with respect to both the thread segments 22 and the bead 34.

Also, if desired, the lower part of the skirt 26 may be radially outwardly thickened as at 42 so as to strengthen the lower portion of the skirt 42 and thus resist squaring above the surface 38.

The resultant squaring of the closure skirt is in part due to an overcamming of the skirt downwardly by continued rotation of the closure relative to the neck finish after a seal has been formed between the closure and the sealing surface 20. In order to provide for the automatic restriction of this axially downward camming of the closure 14, the threads 22 are modified so that they have terminal end portions 44 which are horizontal, or more specifically which lie in a plane disposed normal to the axis of the neck 16. Thus, when a lug 32 begins to engage the thread segment portion 44, no further axially downward camming of the closure 14 is effected by the further rotation of the closure relative to the neck finish.

Next, in order to restrict threading of the closure onto the neck finish 12, the neck finish 12 is provided with a stop 46 which is associated with each of the thread segments 22 for engagement by a respective lug 32. The stop 46 is in the form of a vertical continuation of the horizontal portion 44 of each thread segment 22, with the stop 46 continuing into the bead 34, as is best shown in FIG. 1. As is clearly shown in FIG. 5, after a leading portion of a typical lug 32 engages beneath a thread segment horizontal portion 44, and rotation of the closure is continued, a stop surface 33 on the lug 32 will engage the stop 46 and prevent further rotation of the closure relative to the container.

In the illustrated embodiment of the closure 14, the skirt 26 has an upper portion thereof above the lugs 32 which presents a cylindrical internal surface 48 which is of the same diameter as the external surfaces of the thread segments 22 so as further to support the skirt 26 and prevent squaring. In the illustrated embodiment of the invention, the thread segments 22 project radially outwardly from the neck 16 the same distance as the bead 34 and thus the surface 48 is of the same diameter as the surface 38.

Each thread segment 22 is provided with an undersurface 50 against which an upper surface 52 of a cooperating lug bears. In the illustrated embodiment of the invention, the surfaces 50 and 52 are both disposed parallel to a plane disposed normal to the axis of the neck 16. In accordance with this invention, it is feasible for the surfaces to slope axially upwardly and radially outwardly relative to a plane normal to the neck axis, with the slope being a minimal slope and not to exceed 10°.

It will be apparent from FIG. 1 that the lug stop surface 33 is circumferentially spaced from the thread engaging upper surface 52 of the lug 30.

It will be readily apparent from the foregoing that the undesirable squaring which exists in previous closure-neck finish combinations is eliminated or substantially reduced by a combination of the modifications in the closure and the neck finish. By providing the horizontal thread segment portions 44 and the stops 46, the maximum camming effect is controlled and thus the pressures tending to effect squaring are held to a preselected maximum. At the same time, the skirt 26 of the closure is supported against squaring primarily by the coacting support surface 36 of the bead 34 and the surface 38 of the closure skirt 26, and secondly by the coacting supporting of the skirt 26 by its upper internal surface 48 engaging the outer surfaces of the thread segments 22. The tendency of the lugs to ride radially outwardly relative to the thread segments is eliminated or substantially reduced by holding the angle of the contacting surfaces to a plane normal to the neck axis between 0° and 10° as described above.

By maintaining the upper portion of the skirt 26 cylindrical as opposed to permitting it being squared, the end wall 24 of the closure remains taut or generally drum-like.

It will be readily apparent from FIG. 3 that the modifications in the closure and the neck finish in no way prevent the automatic alignment of the closure skirt with the neck finish as is required for the automatic machine application of the closure to the container.

Although only a preferred embodiment of the neck finish and closure skirt construction has been specifically illustrated and described herein, it is to be understood that minor variations may be made in the neck finish and the closure without departing from the spirit and scope of the invention as defined by the appended claims.

I claim:

1. A closure and neck finish combination, said neck finish having a terminal sealing surface and including a plurality of thread segments projecting radially from a container neck, said closure being formed of a plastic material and including an end panel for sealing engagement with said terminal sealing surface and a depending skirt, said skirt having radially inwardly directed lugs for underlying said thread segments and retaining said closure on said neck finish; the improvement comprising said neck finish including a support surface on said neck below said thread segments, and said skirt having an internal surface area for engaging said support surface for preventing distortion of said skirt due to the loading of said lugs, said thread segments and said lugs having mating surfaces sloping radially outwardly and axially upwardly at a maximum angle of 10° to the axis of said neck.

2. The combination of claim 1 wherein said mating surfaces are frustoconical segments.

3. A closure and neck finish combination, said neck finish having a terminal sealing surface and including a plurality of thread segments projecting radially from a container neck, said closure being formed of a plastic material and including an end panel for sealing engagement with said terminal sealing surface and a depending skirt, said skirt having radially inwardly directed lugs for underlying said thread segments and retaining said closure on said neck finish; the improvement comprising said neck finish including a support surface on said neck below said thread segments, and said skirt having an internal surface area for engaging said support surface for preventing distortion of said skirt due to the loading of said lugs, and an axially extending stop extending between the lower end of each thread segment and said support surface for engagement by said lugs to limit rotation of said closure relative to said container, and each lug having a stop surface spaced circumferentially from a surface of said lug which engages said thread segment.

4. The combination of claim 3 wherein said thread segments and said lugs have mating surfaces sloping radially outwardly and axially upwardly at a maximum angle of 10° to the axis of said neck.

* * * * *